US012435387B2

(12) United States Patent
Garcia Martino et al.

(10) Patent No.: US 12,435,387 B2
(45) **Date of Patent: *Oct. 7, 2025**

(54) METHOD FOR DIP-COATING A METAL STRIP

(71) Applicant: ArcelorMittal, Luxembourg (LU)

(72) Inventors: Angel Garcia Martino, Asturias (ES); Inocencio Garcia-Chapa, Asturias (ES)

(73) Assignee: ArcelorMittal, Luxembourg (LU)

( * ) Notice: Subject to any disclaimer, the term of this patent is extended or adjusted under 35 U.S.C. 154(b) by 0 days.

This patent is subject to a terminal disclaimer.

(21) Appl. No.: 18/196,003

(22) Filed: May 11, 2023

(65) Prior Publication Data

US 2023/0287552 A1 Sep. 14, 2023

Related U.S. Application Data

(63) Continuation of application No. 16/979,232, filed as application No. PCT/IB2019/051190 on Feb. 14, 2019, now Pat. No. 11,692,257.

(30) Foreign Application Priority Data

Mar. 12, 2018 (WO) ..... PCT/IB2018/051603

(51) Int. Cl.
*C23C 2/00* (2006.01)
*C21D 9/56* (2006.01)
(Continued)

(52) U.S. Cl.
CPC ..... *C21D 9/561* (2013.01); *C21D 9/562* (2013.01); *C23C 2/0034* (2022.08);
(Continued)

(58) Field of Classification Search
CPC ..... C21D 9/561; C21D 9/562; C23C 2/0034; C23C 2/00344; C23C 2/0038;
(Continued)

(56) References Cited

U.S. PATENT DOCUMENTS 4,664,953 A 5/1987 Copas et al.
6,923,864 B2 * 8/2005 Dauchelle ..... C23C 2/00 118/63
(Continued)

FOREIGN PATENT DOCUMENTS

CN 202881364 U 4/2013
CN 203247296 U 10/2013
(Continued)

OTHER PUBLICATIONS

Machine Translation of JP-2009068043-A (Year: 2009).*
Machine Translation of WO-2017187226-A1 (Year: 2014).*

*Primary Examiner* — Jessee R Roe
*Assistant Examiner* — Michael Aboagye
(74) *Attorney, Agent, or Firm* — Davidson Kappel LLC

(57) ABSTRACT

Equipment for the continuous hot dip-coating of a metal strip 9 including an annealing furnace, a tank 2 containing a liquid metal bath 3, a snout connecting the annealing furnace and tank 2, through which the metal strip 9 runs in a protective atmosphere and the lower part of the snout, the sabot 5, is at least partly immersed in the liquid metal bath 3 in order to define with the surface of the bath, and inside this snout, a liquid seal 6, an overflow 7 not connected to the snout, the overflow 7 including at least one tray 8, placed in the vicinity of the strip 9 when entering the liquid metal bath 3 and encompassed by liquid seal 6.

15 Claims, 5 Drawing Sheets

(51) Int. Cl.

| | |
|---|---|
| ***C23C 2/02*** | (2006.01) |
| ***C23C 2/06*** | (2006.01) |
| ***C23C 2/40*** | (2006.01) |
| ***C23F 17/00*** | (2006.01) |

(52) U.S. Cl.
CPC ..... *C23C 2/00344* (2022.08); *C23C 2/0038* (2022.08); *C23C 2/004* (2022.08); *C23C 2/02* (2013.01); *C23C 2/022* (2022.08); *C23C 2/0222* (2022.08); *C23C 2/0224* (2022.08); *C23C 2/06* (2013.01); *C23C 2/40* (2013.01); *C23C 2/50* (2022.08); *C23F 17/00* (2013.01)

(58) Field of Classification Search
CPC C23C 2/004; C23C 2/02; C23C 2/022; C23C 2/0222; C23C 2/0224; C23C 2/06; C23C 2/40; C23C 2/50; C23F 17/00
USPC ..... 266/130; 118/400
See application file for complete search history.

(56) References Cited

U.S. PATENT DOCUMENTS

| | | | | |
|---|---|---|---|---|
| 6,936,307 | B2 | 8/2005 | Dauchelle et al. | |
| 11,584,980 | B2 * | 2/2023 | Garcia Martino | C23C 2/06 |
| 2004/0052959 | A1 | 3/2004 | Dauchelle et al. | |
| 2012/0052206 | A1 | 3/2012 | Diez et al. | |
| 2016/0102393 | A1 * | 4/2016 | Schaffrath | C23C 2/40 118/712 |
| 2018/0105916 | A1 | 4/2018 | Takahashi | |
| 2019/0062888 | A1 | 2/2019 | Saint-Raymond et al. | |
| 2019/0144982 | A1 * | 5/2019 | Veg | C23C 2/004 118/400 |

FOREIGN PATENT DOCUMENTS

| | | | | |
|---|---|---|---|---|
| CN | 107354288 | A | 11/2017 | |
| CN | 107447174 | A | 12/2017 | |
| JP | H0459955 | A | 2/1992 | |
| JP | H05279827 | A | 10/1993 | |
| JP | H11172400 | A | 6/1999 | |
| JP | 2007247044 | A | 9/2007 | |
| JP | 2009068043 | A * | 4/2009 | |
| KR | 20040097552 | A | 11/2004 | |
| KR | 20100076405 | A | 7/2010 | |
| KR | 20130044972 | A | 5/2013 | |
| WO | WO2014050082 | A1 | 4/2014 | |
| WO | WO2016148417 | A1 | 9/2016 | |
| WO | WO-2017187226 | A1 * | 11/2017 | C23C 2/003 |

* cited by examiner

METHOD FOR DIP-COATING A METAL STRIP

This is a continuation of U.S. patent application Ser. No. 16/979,232 filed on Sep. 9, 2020, now U.S. Pat. No. 11,692,257, which is a national phase of PCT/IB2019/051190 filed on Feb. 14, 2019 claiming priority to International Patent Application PCT/IB2018/051603, filed on Mar. 12, 2018. All of the above are hereby incorporated by reference herein.

The present invention relates to equipment for the hot dip-coating of a metal strip comprising an annealing furnace, a tank containing a liquid metal bath, a snout connecting the annealing furnace and the tank as well as an overflow separated from the snout. In other words, the snout has one side at the end of the annealing furnace, usually high up, and the other one a bit under the liquid metal bath surface, creating a seal. Such a positioning aims to protect the metal strip against oxidation from the annealing furnace until it reaches the liquid metal bath. The overflow is located at the surface of the liquid metal bath encompassed by the snout.

BACKGROUND

During the coating process, the entering position of the strip into the bath changes over time due to different factors, e.g. changes in the strip entry position, and thus affects the optimal position of the overflow. Consequently, the overflow needs to be shifted and moved to the optimal position during the process.

Moreover, while in use, the equipment deteriorates or breaks down due to various effects. For example, the immersed part of the snout is subject to corrosion, the pump or the level indicator of the overflow happens to malfunction. In order to overcome those issues, some part of the snout or the overflow needs to be replaced or repaired, such operations lead to the strip cut, a decrease in productivity and higher cost of manufacturing.

Patent FR 2 816 639 relates to an apparatus for the continuous dip coating of a metal strip. This equipment improves the surface quality of the strip by reducing its defect density by adding an overflow to the snout. In order to do so, overflows are installed in the lengthening of the snout, collecting the dross near the strip.

Patent WO 2017/187225 describes an apparatus for the continuous dip coating of a metal strip. This equipment improves the apparatus from FR 2 816 639 explained above and allows the position tuning of the snout and the overflows regards the strip. In order to do so, the snout is equipped with a mobile box of discharge in rotation in regards to the metal strip around a first axis of rotation and the box of discharge is mobile in rotation compared to the upper part of the sheath around a second axis of rotation. Moreover, the articulation allowing the rotation of the box of discharge compared to the upper part of the sheath is a connection pivot.

However, by using the above equipment, the right setting of the overflow is complex and, if not handled properly, may lead to inadequate positioning. The setting complexity is due to the difficulties of levelling both sides of the overflow by making an horizontal displacement without vertical displacement. Moreover, this needs lot of mechanisms leading up to higher probability of failure. Furthermore, when one part is broken, in order to repair it, the whole snout has to be removed and sometimes replaced.

SUMMARY OF THE INVENTION

Consequently, there is a need to find a simpler and more reliable overflow tuning device, as well as one easing its replacement. The solution should also ease the correct positioning of the overflow. Furthermore, it would be very advantageous, if the overflow could be removed without cutting the strip so it remains threaded and reduces the impact on the production.

It is an object of the present invention to provide an equipment for the continuous hot dip-coating of a metal strip comprising:

- an annealing furnace,
- a tank containing a liquid metal bath,
- a snout connecting the annealing furnace and said tank, through which the metal strip runs in a protective atmosphere and the lower part of said snout, the sabot, is at least partly immersed in the liquid metal bath in order to define with the surface of the bath, and inside this snout, a liquid seal,
- an overflow not connected to the snout, said overflow comprising at least one tray, placed in the vicinity of the strip when entering said liquid metal bath and encompassed by said liquid seal.

The present invention also provides a method for depositing a metallic coating by hot-dip coating in such equipment and a method for replacing a worn lower part of a snout from a hot-dip coating process in such equipment.

Other characteristics and advantages of the invention will become apparent from the following detailed description of the invention.

BRIEF DESCRIPTION OF THE DRAWINGS

To illustrate the invention, various embodiments and trials of non-limiting examples will be described, particularly with reference to the following figures.

DETAILED DESCRIPTION

Figure 1:
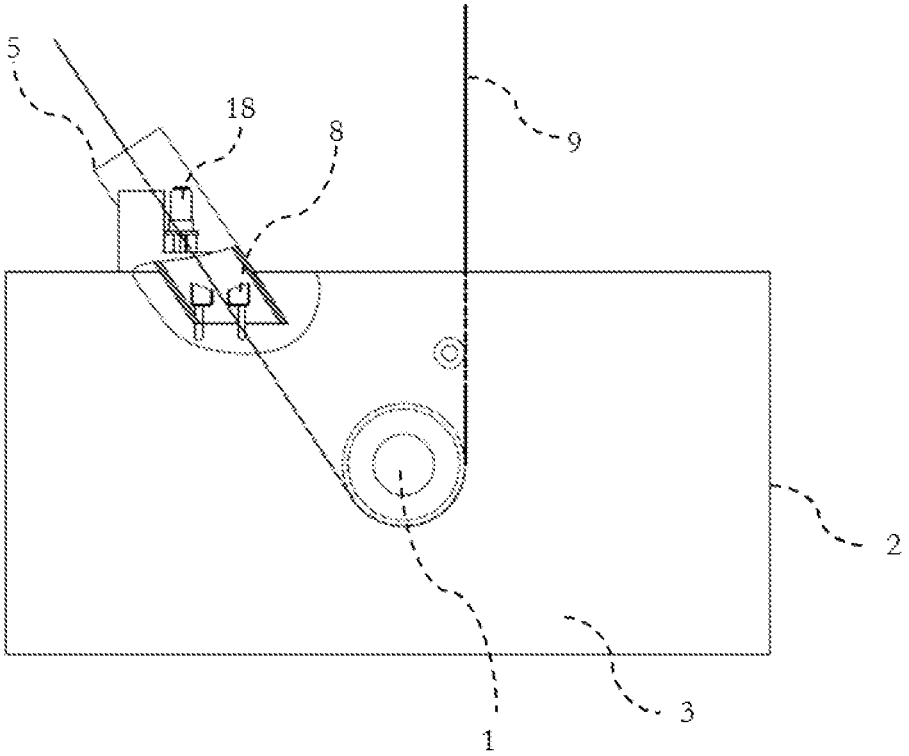
FIG. 1 is a sectional view of the invention where the invention can be seen in use.

The invention relates to equipment for the continuous hot dip-coating of a metal strip 9 comprising an annealing furnace 100 (shown schematically), a tank 2 containing a liquid metal bath 3, a snout 105 (shown schematically) connecting the annealing furnace and said tank 2, through which the metal strip 9 runs in a protective atmosphere and the lower part of said snout, the sabot 5, is at least partly immersed in the liquid metal bath 3 in order to define with the surface of the bath, and inside this snout, a liquid seal 6 (See FIG. 9), an overflow 7 (see FIG. 3) not connected to the snout, said overflow comprising at least one tray 8, placed in the vicinity of the strip 9 when entering said liquid metal bath 3 and encompassed by said liquid seal 6.

In the prior art, it seems that it is not possible to easily and quickly remove only the overflow in order to clean it, repair it or change it. Moreover, it seems that it is also not possible to remove only the part of the snout in contact with the bath in order to change it or clean it without removing the whole or a major part of snout. On the contrary, with the equipment according to the present invention, it is possible to easily remove the overflow without removing the whole snout. Furthermore, it is possible to separate the part at least partly immersed in the coating from the snout without removing the whole snout or a major part of it.

Advantageously, said snout can be lifted and lowered up to 100 cm, more preferably up to 120 cm. For example, the snout can be lifted up to 120 cm, meaning that apparently, between the lowest and highest position of the sabot, there is a difference of 120 cm. Such an elevation range eases the removal of the overflow.

Advantageously, said overflow 7 is formed by an internal wall 10 facing one side of the strip, directed toward the surface of the liquid seal, the upper edge 10.1 of which internal wall is positioned below the surface of said bath 3, an external wall 11 facing the snout, directed toward the surface of the liquid seal, the upper edge 11.1 of which external wall is positioned above the surface of said bath 3, a connection part 20 (see FIG. 8) between said external 11 and internal 10 wall lower edges, also a side wall 13 at each shared extremity of the previous mentioned walls connecting all the edges and the internal wall upper edge 10.1 is lower than the external wall upper edge 11.1.

Advantageously, said overflow 7 is provided with means for maintaining the level 18 (See FIG. 3) of liquid metal at a level below the surface of the liquid seal in order to set up a natural flow of the liquid metal in this tray 8, said natural flow of the liquid metal being greater than 50 mm in order to prevent metal oxide particles and intermetallic compound particles from rising as a countercurrent to the flow of liquid metal.

Advantageously, the upper edge of the first internal wall 14 of the tray 8 comprises, in a longitudinal direction, a succession of hollows and projections. Without to be bound by any theory, it permits to reduce or suppress the splashing of the coating on the strip and ease the flow along the wall.

Advantageously, said overflow 7 is removable when said snout is lifted. When the snout is lifted, there is nothing in the way of the overflow removal, which enables an easier removal.

Advantageously, said tray 8 and means for maintaining the level 18 are fixed to the edges 21 and 22 of the tank 2 by supports 4 and 16. For example, the supports are welded to the tray and means for maintaining the level and the supports are screwed to the tank edges.

Advantageously, the tray 8 is connected to the means for maintaining the level 18 and the supports 16 by connectors 15, said connectors 15 of the overflow are curved towards the bottom of the coating bath so that the lowest part of the connectors is beneath the liquid seal allowing the end of the lower part of the snout, the sabot, to be under the liquid seal and above the lowest part of the support. For example, the lowest part of the connectors can be in a "U", "V", or semicircular shape.

Advantageously, wherein the supports 16 and 4 on which the tray 8 and the means for maintaining the level 18 are fixed are shiftable/movable along the edges of the bath allowing the overflow 7 to shift along the edges of said bath. For example, the supports on one or both sides can be attached to a piston or an hydraulic cylinder system which can be shifted. More preferably, supports on both sides of the overflow are attached to a slidable system. Consequently, without to be bound by any theory, the overflow moves quasi-perpendicularly to the axis formed by the surface of the coating bath and the strip. For example, the supports and thus the overflow are shiftable on a distance of at least 50 cm along the edge axis. More advantageously, the supports are automatically shifted regards to the strip position.

Advantageously, the supports 16 and 4 on which the tray 8 and the means for maintaining the level 18 are fixed are shiftable along the perpendicular to the bath surface. It permits to tune the tray level in order to keep it at the bath level. This system works well in combination with immersion of ingot to finely tune the overflow level. For example, it can be achieved by using a mechanical system to shift vertically the overflow.

Advantageously, the overflow has 2 trays 8 positioned symmetrically to the entry of the metal strip in the liquid metal 3.

Advantageously, the overflow 7 is composed of one tray 8 continuously surrounding the metal strip 9 formed by an internal wall 10 facing one side of the strip, directed toward the surface of the liquid seal, the upper edge of which internal wall is positioned below the surface of said bath, an external wall 11 facing the snout directed toward the surface of the liquid seal, the upper edge of which external wall is positioned above the surface of said bath, a horizontal wall 20 between the external and internal wall lower edges 11.2 and 10.2. Without to be bound by any theory, it permits to have a unique peripheral compartment.

Advantageously, the snout comprises an upper part and a lower part which is removable.

The invention also relates to a method for depositing a metallic coating by hot-dip coating in an installation comprising:

- the recrystallization annealing of the steel sheet in an annealing furnace
- the passage of the steel sheet from the annealing furnace to the hot-dip coating bath in the snout
- the hot dip-coating of the annealed steel sheet in a bath The invention also relates to a method for replacing a worn lower part of a snout from a hot dip-coating process in an installation wherein:

- said snout is lifted setting the lower removable part above the liquid bath
- the overflow is lifted and the removed and/or the removable lower part of the snout is removed and replaced by a new one.

The following description will concern an installation for the continuous galvanization of a metal strip. But, the present invention is applicable to every processes of continuous coating in which surface pollutants are present, the liquid seal should remain clean and the overflow needs to be removed easily.

After the cold rolling section, the metal strip passes through an annealing furnace (not represented), in a reducing atmosphere in order to recrystallize the metal strip after the strain hardening due to the cold rolling and prepare its surface state increasing the chemical reaction happening during the galvanization.

In the annealing furnace, the metal strip is heated to temperatures generally comprised between 65° and 900° C. Right after, the metal strip 9 passes in a galvanization installation as depicted FIG. 1.

This installation comprises an annealing furnace (not represented), a tank 2 containing a liquid metal bath 3, said liquid metal bath is generally composed of liquid zinc containing chemical elements such as aluminum and iron as well as addition elements like possibly lead and antimony. The bath temperature is generally around 460° C.

After the annealing furnace, the metal strip 9 is cooled down to a temperature close to the one of the bath and is then immerged in the metal liquid bath 3.

During this immersion, depending on the elements present in the bath, an intermetallic alloy is formed, generally Fe—Zn—Al, permitting to assure the liaison between the metal strip and the remaining zinc on said metal strip after drying.

As depicted in FIG. 1, the metal strip passes through the sabot 5 and the snout (not represented, but in the lengthening of the sabot) in a protective atmosphere.

Figure 2:
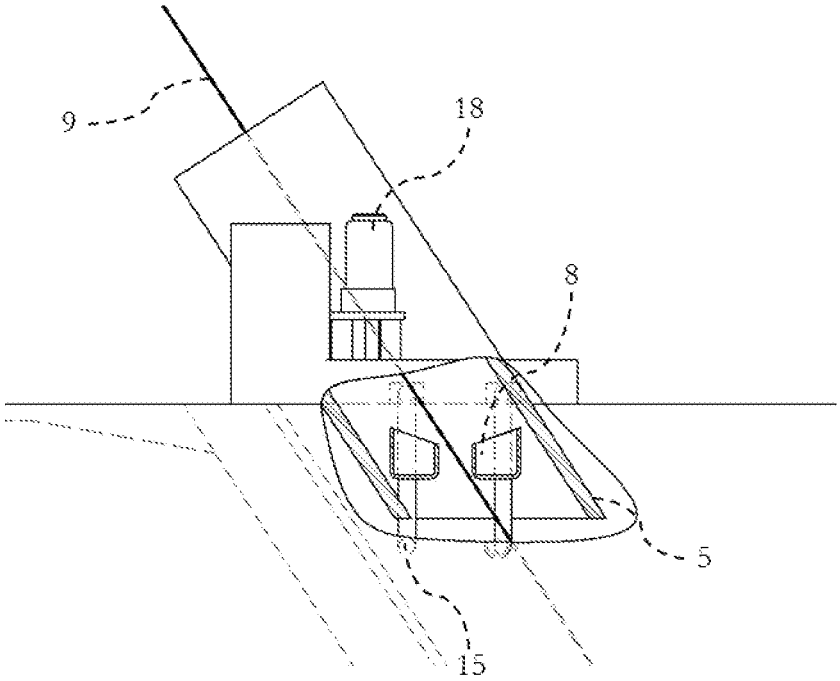
FIG. 2 is a sectional view of the invention focused on the sabot and the overflow
Figure 9:
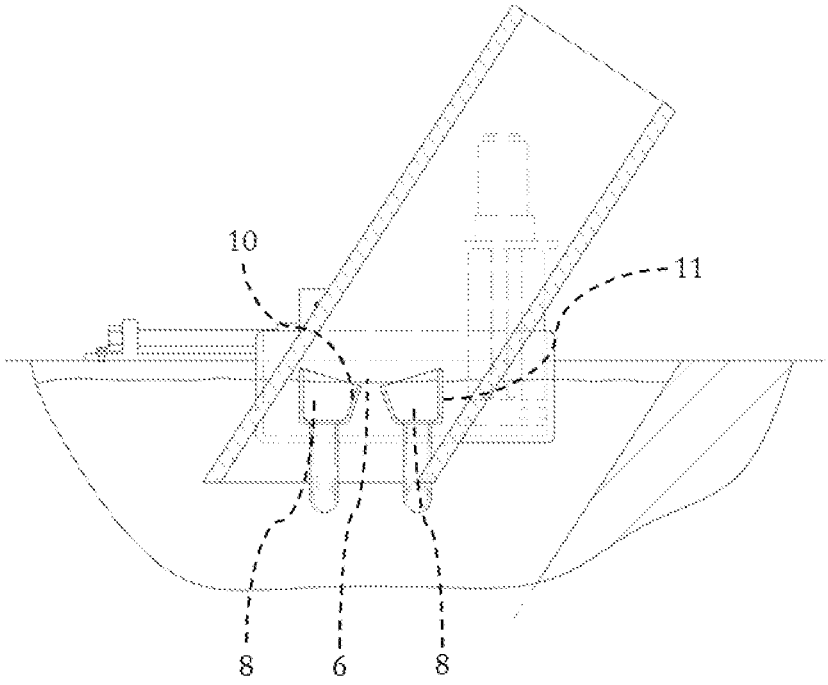
FIG. 9 shows the level of the liquid bath regards the trays when in use and the liquid seal.

The snout and the sabot 5 have, represented on FIG. 2, a rectangular transversal section. The sabot 5 is partly immersed in the bath in order to make a liquid seal 6 in the sabot, as represented in FIG. 9. Thus the metal strip 9 when entering the bath goes through the liquid seal and between the two trays 8.

Then the metal strip is deflected by the roller 1 and then goes to the next stage, where it is generally dried out by jet nozzles blowing air (not represented).

Figure 3:
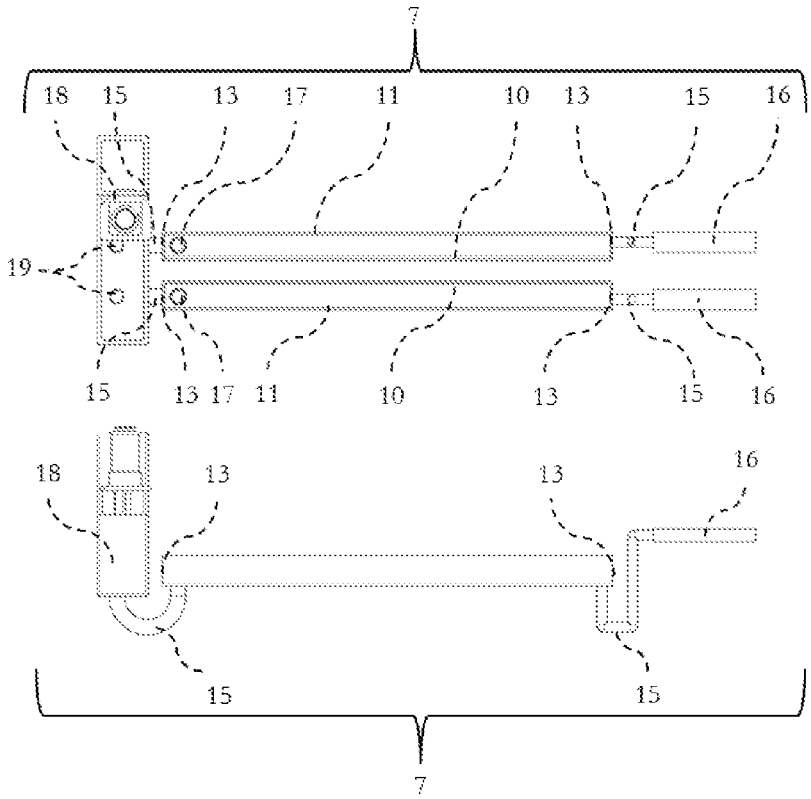
FIG. 3 is a possible design of the overflow
Figure 6:
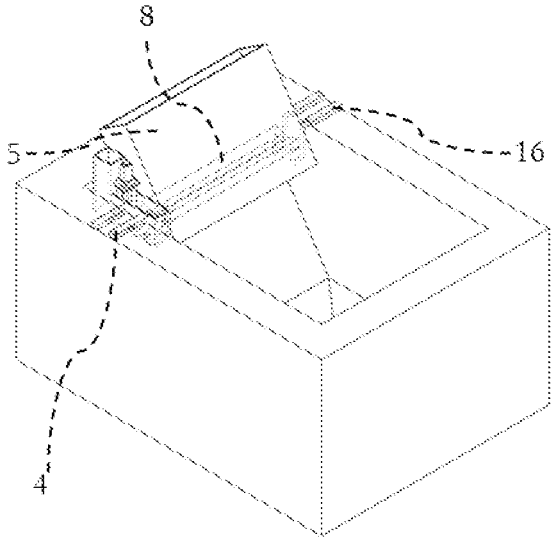
FIG. 6 is a scheme of the overflow being laid on the bath edges.
Figure 7:
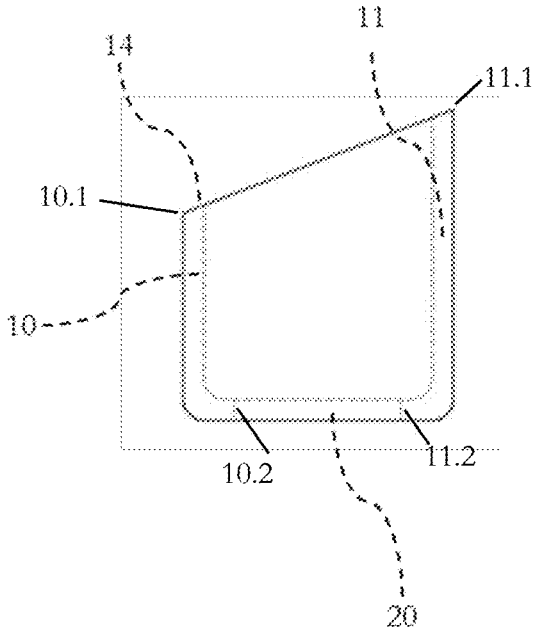
FIG. 7 exhibits a configuration for the tray.

As represented on FIGS. 3 and 6, the overflow can be composed of two rectangular trays 8, curved connectors 15, means for maintaining the level 18 and supports 16 and 4. On one side, the holes 17 in the trays on the means for maintaining the level and the ones of the means for maintaining the level 19 are connected by the hollow curved connector 15 creating a passage between the tray and the means for maintaining the level 18. As it can be seen on FIG. 10, supports 4 fixed on the means for maintaining the level 18, are laid on the edge 21 of the tank 2. On the other side, the supports 16 are attached to the tray 8 (precisely the connector 15) and set on the edge 22 of the tank 2.

The trays are formed by an internal wall 10 facing one side of the strip, directed toward the surface of the liquid seal, the upper edge of which internal wall is positioned below the surface of said bath, an external wall 11 facing the snout, directed toward the surface of the liquid seal, the upper edge of which external wall is positioned above the surface of said bath, a connection part 20 between said external 11 and internal 10 wall lower edges and also a wall at each shared extremity 13 of the previous mentioned walls connecting all the edges. One key feature of the tray is that the external wall upper edge is higher than the internal wall upper edge. Without to be bound by any theory, all those elements should lead to a natural flow of the liquid metal to the tray and thus lead to a cleaner surface close to the metal strip.

Figure 8:
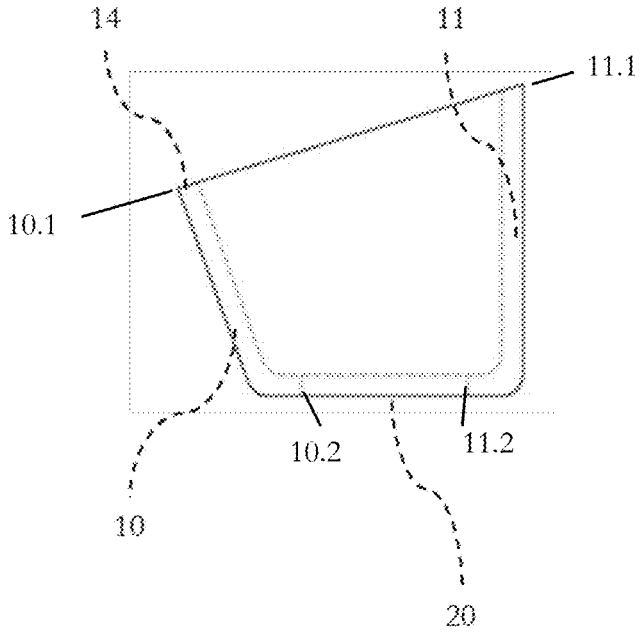
FIG. 8 exhibits a different configuration for the tray.

Without to be bound by any theory, as it can be seen FIG. 8, the internal wall can be slightly inclined toward the strip permitting to reduce the splash on the strip.

Furthermore, the means for maintaining the level can be composed of a pump sucking in the compartment 12 and throwing back in liquid metal bath.

Figure 4:
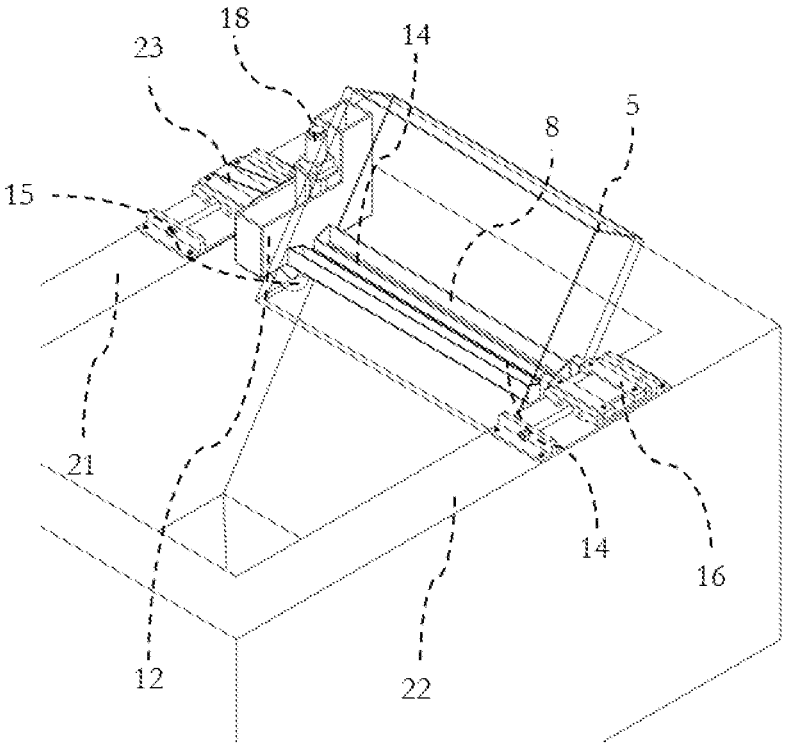
FIG. 4 is an example of the layout of the sabot, the overflow and the shifting system.
Figure 5:
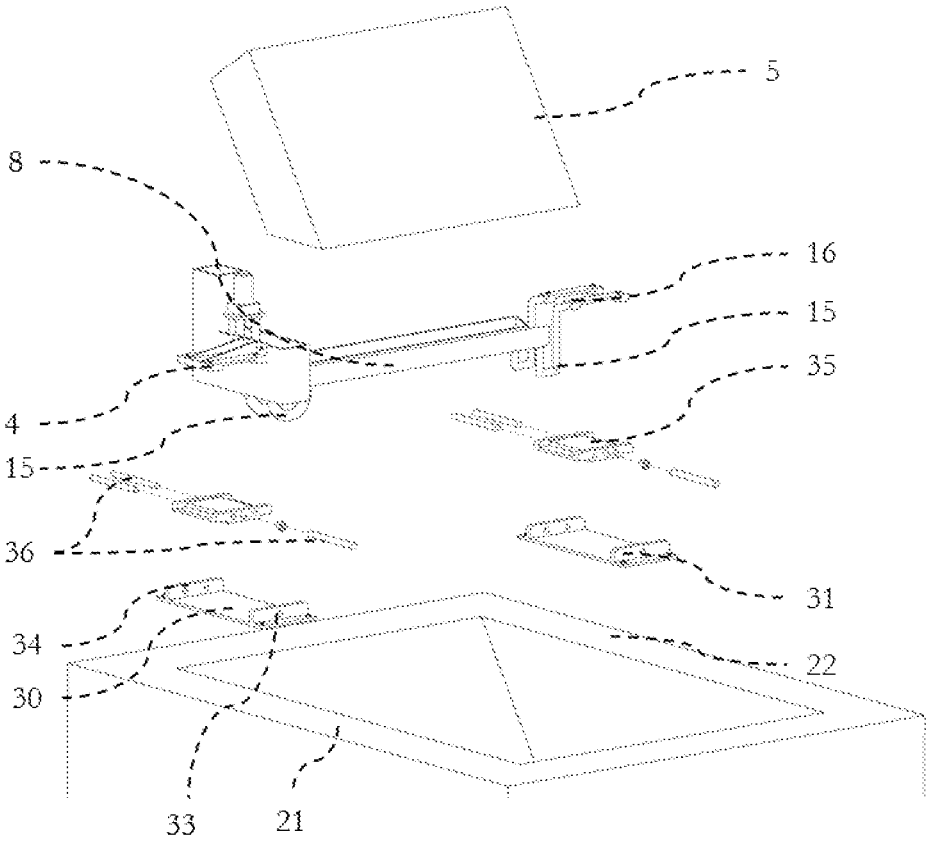
FIG. 5 is a breakdown of the different elements composing a sabot, an overflow and shifting systems.

FIGS. 4 and 5 exhibit a possible mechanism 23 for the shifting of the overflow. A quasi-rectangular plate 30 is screwed on the edge of the bath by two screws on each lateral side. The plate 30 has one wall 31 on each lateral side, but not at its extremity, the first one has a central hole 33 while the second one has two holes 34 spaced of approximately a third of the wall length. On this quasi-rectangular plate 30 is laid a metallic bloc 35. This metallic bloc is thinner on its lateral edges, making a "U" shape on the upper and lower sides, has three holes which can be aligned with the holes of the quasi-rectangular plate 30. Three screws 36 pass through the holes 33, 34 and said holes in order to fix the bloc and the plate together. On this bloc 35 is fixed the support extremity 4, 16 by screws screwed to the thinner edges.

It is obvious for the skilled person that the dimensions of the equipment described in the patent depend on the line configuration, especially the maximum strip width processed in the line. The skilled person should always keep in mind that the width of the overflow should be wider than the width strip.

EXAMPLES

Example 1

In a particular embodiment, using the teaching of the present invention, the bath length is of 3900 mm and its width is of 2720, the snout length is of 2300 mm and 525 mm wide permitting the passage of a 1800 mm wide strip. The sabot height is of 1283 mm when in use, the tray is of 2200 mm long and 150 mm wide and high for the external wall and 100 mm high for the internal wall. The shiftable system 23 can be shifted on 420 mm along the bath width and is screwed by four screws to the bath side wide of 500 mm, two at each extremity. The shiftable system 23 on which the supports are attached is 500 mm long. The upper part of the internal wall is 120 mm below the bath side while the external wall is 70 mm below the bath side. The tray is fixed on one side to the shiftable system by means of a two 500 mm long plate screwed two times each and on the other side, the one containing the level indicator, the shiftable system is fixed to the level indicator system by three screws along the width of the bath.

Example 2

In a preferred embodiment, the classical overflow (like in FR 2 816 639) has been replaced by the overflow described in this patent.

With the classical overflow, the steps necessary to change an overflow are generally the followings:

A) Stop the line,
B) Cooling (wait),
C) Remove bath hardware,
D) Lower the pot,
E) Move the pot to garage position,
F) Install platform,
G) Cut the strip,
H) Remove the snout (with the overflow),
I) Install the new snout (with the overflow),
J) Treading of the strip,
K) Weld the strip,
L) Remove the platform,
M) Move the pot from the garage position,
N) Raise the pot,
O) Install bath hardware,
P) Inert the snout,
Q) Heat up,
R) Restart the line.

This procedure takes about twenty-four hours when the classical overflow is used. Whereas when the removable overflow is mounted, only the steps A, C, D, N, O, P, Q and R are done. Thus the replacement of the removable overflow takes only 8 hours.

What is claimed is:

1. Equipment for continuous hot dip-coating of a metal strip, the equipment comprising:

an annealing furnace;

a tank containing a liquid metal bath;

a snout connecting the annealing furnace and the tank, the metal strip running through the snout in a protective atmosphere, a lower part of the snout being at least partly immersed in the liquid metal bath in order to define with a surface of the bath, and an inside of the snout, a liquid seal; and an overflow independently movable with respect to the snout and including at least one tray placed in a vicinity of the strip when the strip enters the liquid metal bath and is located within the liquid seal, the at least one tray being formed by:

an internal wall facing one side of the strip, directed toward a surface of the liquid seal, an internal wall upper edge being positioned below the surface of the bath;

an external wall facing the snout, directed toward the surface of the liquid seal, an external wall upper edge being positioned above the surface of the bath;

a connector part between the external and internal wall lower edges and also a side wall at each shared extremity of the internal and external walls connecting all edges;

the internal wall upper edge being lower than the external wall upper edge.

2. The equipment as recited in claim 1 wherein the snout is liftable and lowerable.

3. The equipment as recited in claim 1 wherein the overflow includes means for maintaining a level of liquid metal at a level below the surface of the liquid seal in order to set up a natural flow of the liquid metal in the at least one tray, the natural flow of the liquid metal being greater than 50 mm in order to prevent metal oxide particles and intermetallic compound particles from rising as a countercurrent to the flow of liquid metal.

4. The equipment as recited in claim 1 wherein the internal wall upper edge includes, in a longitudinal direction, a succession of hollows and projections.

5. The equipment as recited in claim 1 wherein the overflow is removable when the snout is lifted.

6. The equipment as recited in claim 3 wherein the at least one tray and the means for maintaining the level are fixed to the edges of the tank by supports.

7. The equipment as recited in claim 6 wherein the at least one tray is connected to the means for maintaining the level and support by connectors, the connectors of the overflow being curved towards a bottom of the coating bath so that a lowest part of the connectors is beneath the liquid seal allowing the lower part of the snout to be under the liquid seal and above a lowest part of the support.

8. The equipment as recited in claim 6 wherein the supports are movable along the edges of the bath allowing the overflow to shift along the edges of said bath.

9. The equipment as recited in claim 6 wherein the supports are shiftable along a perpendicular to the bath surface.

10. The equipment as recited in claim 1 wherein the overflow has two trays positioned symmetrically to an entry of the metal strip in the liquid metal bath.

11. The equipment as recited in claim 1 wherein the snout includes the lower part is removable.

12. The equipment as recited in claim 3 wherein the means for maintaining the level is a pump.

13. A method for depositing a metallic coating by hot-dip coating in the equipment as recited in claim 1, the method comprising:

recrystallization annealing of the metal strip in an annealing furnace;

passing the metal strip from the annealing furnace to the liquid metal bath in the snout;

and hot dip-coating of the annealed metal strip in the liquid metal bath.

14. A method for replacing a worn lower part of a snout from a hot dip-coating process in the equipment as recited in claim 1, the method comprising:

lifting the snout to set the lower part above the liquid bath, the lower part being revocable; and lifting the overflow and removing the lower part of the snout and replacing the lower part by a new lower part.

15. Equipment for continuous hot dip-coating of a metal strip, the equipment comprising:

an annealing furnace;

a tank containing a liquid metal bath;

a snout connecting the annealing furnace and the tank, the metal strip running through the snout in a protective atmosphere, a lower part of the snout being at least partly immersed in the liquid metal bath in order to define with a surface of the bath, and an inside of the snout, a liquid seal; and an overflow independently movable with respect to the snout and composed of one tray continuously surrounding the metal strip formed by an internal wall facing one side of the strip, directed toward the surface of the liquid seal, an internal wall upper edge being positioned below the surface of the bath, an external wall facing the snout directed toward the surface of the liquid seal, an external wall upper edge being positioned above the surface of the bath, a horizontal wall between the external and internal wall lower edges.

* * * * *